US006932093B2

(12) United States Patent
Ogden et al.

(10) Patent No.: US 6,932,093 B2
(45) Date of Patent: Aug. 23, 2005

(54) METHODS AND APPARATUS FOR WASHING GAS TURBINE ENGINE COMBUSTORS

(75) Inventors: Paul James Ogden, Mason, OH (US); Craig Douglas Young, Maineville, OH (US); Steven Clayton Vise, Loveland, OH (US)

(73) Assignee: General Electric Company, Schenectady, NY (US)

( * ) Notice: Subject to any disclaimer, the term of this patent is extended or adjusted under 35 U.S.C. 154(b) by 299 days.

(21) Appl. No.: 10/372,889

(22) Filed: Feb. 24, 2003

(65) Prior Publication Data

US 2004/0163678 A1 Aug. 26, 2004

(51) Int. Cl.[7] ..... B08B 9/00; B08B 3/02

(52) U.S. Cl. ..... 134/22.1; 134/22.18; 134/23; 134/169 A; 134/198

(58) Field of Search ..... 134/22.1, 22.18, 134/23, 24, 32, 33, 116, 166 R, 169 A, 169 R, 198; 239/533.1, 533.2

(56) References Cited

U.S. PATENT DOCUMENTS

| | | | | |
|---|---|---|---|---|
| 3,623,668 A | | 11/1971 | Freid, et al. | |
| 4,059,123 A | | 11/1977 | Bartos et al. | |
| 4,196,020 A | * | 4/1980 | Hornak et al. | 134/167 R |
| 4,327,547 A | | 5/1982 | Hughes et al. | |
| 4,713,120 A | | 12/1987 | Hodgens, II et al. | |
| 4,834,912 A | | 5/1989 | Hodgens, II et al. | |
| 5,011,540 A | * | 4/1991 | McDermott | 134/23 |
| 5,102,054 A | * | 4/1992 | Halvorsen | 239/533.2 |
| 5,117,637 A | | 6/1992 | Howell et al. | |
| 5,197,638 A | * | 3/1993 | Wood | 222/212 |
| 5,239,816 A | | 8/1993 | Holt, III | |
| 5,273,395 A | | 12/1993 | McDermott | |
| 5,291,732 A | | 3/1994 | Halila | |
| 5,307,637 A | | 5/1994 | Stickles et al. | |
| 5,630,319 A | | 5/1997 | Schilling et al. | |
| 5,657,633 A | | 8/1997 | Brueggert | |
| 5,725,611 A | | 3/1998 | Wright et al. | |
| 5,868,860 A | * | 2/1999 | Asplund | 134/22.1 |
| 6,047,539 A | | 4/2000 | Farmer | |
| 6,073,637 A | * | 6/2000 | Hayward et al. | 134/22.1 |
| 6,310,022 B1 | | 10/2001 | Amiran | |
| 6,553,768 B1 | * | 4/2003 | Trewin et al. | 60/772 |

FOREIGN PATENT DOCUMENTS

| | | |
|---|---|---|
| EP | 0955457 A3 | 7/2002 |

* cited by examiner

*Primary Examiner*—Michael Barr
*Assistant Examiner*—Saeed Chaudhry
(74) *Attorney, Agent, or Firm*—William Scott Andes; Armstrong Teasdale LLP

(57) ABSTRACT

A method facilitates washing a gas turbine engine combustor. The method comprises coupling a nozzle assembly against the combustor, wherein the nozzle assembly includes an inlet end, a discharge end, a hollow nozzle body extending therebetween, and a centerbody positioned within the nozzle body, coupling the nozzle assembly to a fluid source, and discharging an annulus of fluid from the nozzle assembly into the combustor to facilitate removing particulate matter from the combustor.

20 Claims, 4 Drawing Sheets

METHODS AND APPARATUS FOR WASHING GAS TURBINE ENGINE COMBUSTORS

BACKGROUND OF THE INVENTION

This application relates generally to gas turbine engines and, more particularly, to methods and apparatus for removing particulate matter from gas turbine engine combustors.

Combustors are used to ignite fuel and air mixtures in gas turbine engines. Known combustors include at least one dome attached to a combustor liner that defines a combustion zone. Fuel injectors are attached to the combustor in flow communication with the dome and supply fuel to the combustion zone. Fuel enters the combustor through a dome assembly attached to a spectacle or dome plate.

The dome assembly includes an air swirler secured to the dome plate, and radially inward from a flare cone. The flare cone is divergent and extends radially outward from the air swirler to facilitate mixing the air and fuel, and spreading the mixture radially outwardly into the combustion zone. A divergent deflector extends circumferentially around the flare cone and radially outward from the flare cone. The deflector prevents hot combustion gases produced within the combustion zone from impinging upon the dome plate. At least some known deflectors include integrally formed cooling passages which direct air towards the flare cone to facilitate impingement backside cooling of the flare cone.

During operation, particulate matter ingested into the engine may undesirably accumulate in the impingement passages and block the flow of cooling air through the passages. Over time, continued operation with blocked cooling air passages may cause premature failure of the flare cone. To facilitate preventing overheating of the flare cone, known combustors are periodically inspected and washed to remove any particulate matter that may have built up. Known wash systems spray water, or a mixture of water and detergent, from a spray nozzle downstream into the combustor to remove accumulated particulate matter from the combustor. Such water washing systems restore some of the losses, but because the impingement cooling passages are not visibly accessible for inspection, and as such, the water washes may not adequately remove the particulate matter from the impingement cooling passages. Additionally, because of the orientation of the deflector-flare cone assembly, particulate matter dislodged upstream from the passages may become forcibly lodged in the passages as the cleaning solution is channeled downstream through the combustor.

BRIEF SUMMARY OF THE INVENTION

In one aspect, a method for washing a gas turbine engine combustor is provided. The method comprises coupling a nozzle assembly against the combustor, wherein the nozzle assembly includes an inlet end, a discharge end, a hollow nozzle body extending therebetween, and a centerbody positioned within the nozzle body, coupling the nozzle assembly to a fluid source, and discharging an annulus of fluid from the nozzle assembly into the combustor to facilitate removing particulate matter from the combustor.

In another aspect of the invention, a nozzle assembly for directing fluid into a gas turbine engine combustor for removing particulate matter. The nozzle assembly includes a nozzle body and a centerbody. The nozzle body extends between an inlet end and a discharge end, and the body defines a cavity therein. The centerbody is positioned within the nozzle body such that an annular gap is defined between the centerbody and the nozzle body. The gap is segmented. The centerbody is configured to couple the nozzle assembly to the combustor. The nozzle assembly is for discharging an annulus of fluid through the gap into the combustor.

In a further aspect, a method for washing a gas turbine engine combustor including an air swirler, and a deflector-flare cone assembly that extends circumferentially around the swirler is provided. The method comprises coupling a nozzle assembly to the deflector-flare cone assembly, wherein the nozzle assembly includes an inlet end, a discharge end, a hollow nozzle body extending therebetween, and a centerbody positioned within the nozzle body, coupling the nozzle assembly inlet end to a fluid source, and discharging fluid in an upstream direction from the nozzle assembly into the combustor to facilitate removing particulate-matter from the combustor.

DETAILED DESCRIPTION OF THE INVENTION

Figure 1:
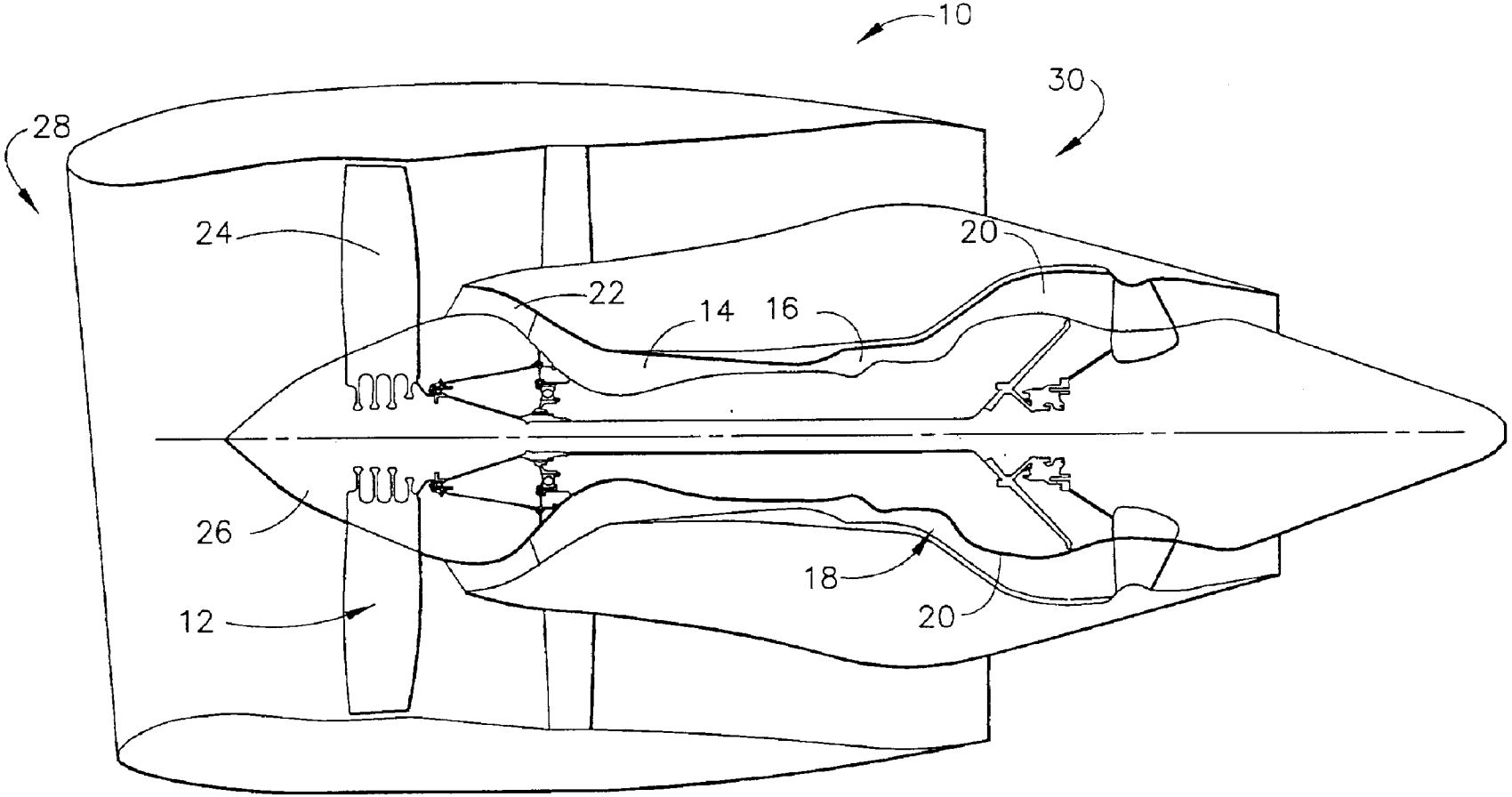
FIG. 1 is a schematic illustration of a gas turbine engine.

FIG. 1 is a schematic illustration of a gas turbine engine 10 including a fan assembly 12, a high pressure compressor 14, and a combustor 16. Engine 10 also includes a high pressure turbine 18, a low pressure turbine 20, and a booster 22. Fan assembly 12 includes an array of fan blades 24 extending radially outward from a rotor disc 26. Engine 10 has an intake side 28 and an exhaust side 30. In one embodiment, gas turbine engine 10 is a GE90 engine commercially available from General Electric Company, Cincinnati, Ohio.

In operation, air flows through fan assembly 12 and compressed air is supplied to high pressure compressor 14. The highly compressed air is delivered to combustor 16. Airflow from combustor 16 drives turbines 18 and 20, and turbine 20 drives fan assembly 12.

Figure 2:
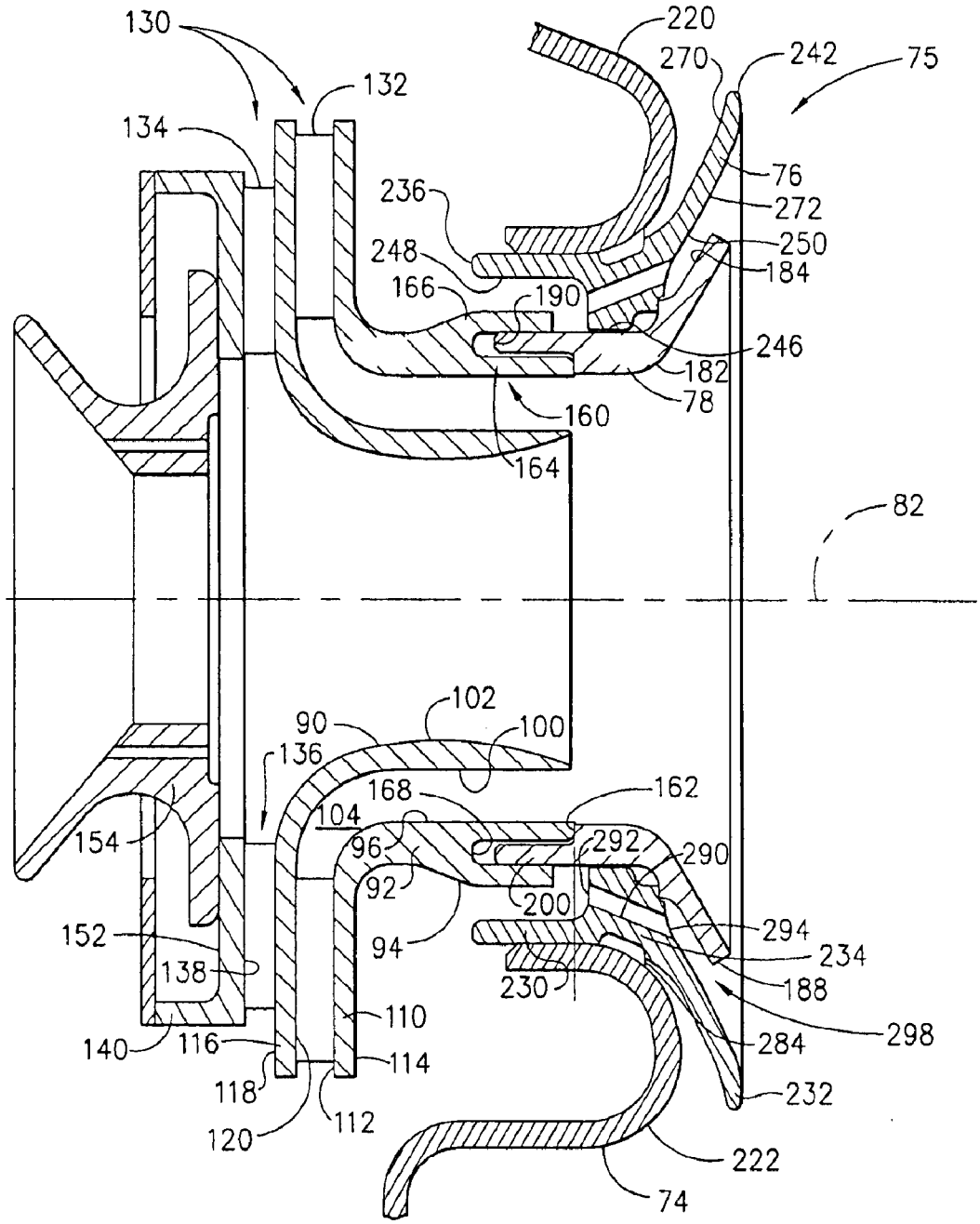
FIG. 2 is a cross-sectional view of an exemplary combustor dome assembly that may be used with the engine shown in FIG. 1.

FIG. 2 is a cross-sectional view of an exemplary combustor dome assembly 70 that may be used with combustor 16. Combustor dome assembly 70 includes a dome plate or spectacle plate 74 and an integral a deflector-flare cone assembly 75 having a deflector portion 76 and a flare cone portion 78. Deflector-flare cone assembly 75 is annular and is substantially concentric with respect to a combustor center longitudinal axis of symmetry 82.

Combustor 16 also includes an annular air swirler 90 having an annular exit cone 92 disposed symmetrically about center longitudinal axis of symmetry 82. Exit cone 92 includes a radially outer surface 94 and a radially inwardly facing flow surface 96. Annular air swirler 90 includes a radially outer surface 100 and a radially inwardly facing flow surface 102. Exit cone flow surface 96 and radially outer surface 100 define an aft venturi channel 104 used for channeling a portion of air therethrough and downstream.

More specifically, exit cone 92 includes an integrally formed outwardly extending radial flange portion 110. Exit cone flange portion 110 includes an upstream surface 112 that extends from exit cone flow surface 96, and a substantially parallel downstream surface 114 that is generally perpendicular to exit cone flow surface 96. Air swirler 90 includes a integrally formed outwardly extending radial flange portion 116 that includes an upstream surface 118 and a substantially parallel downstream surface 120 that extends from air swirler flow surface 102. Air swirler flange surfaces 118 and 120 are substantially parallel to exit cone flange surfaces 112 and 114, and are substantially perpendicular to air swirler flow surface 102.

Air swirler 90 also includes a plurality of circumferentially spaced swirl vanes 130. More specifically, a plurality of aft swirl vanes 132 are slidably coupled to exit cone flange portion 110 within aft venturi channel 104. A plurality of forward swirl vanes 134 are slidably coupled to air swirler flange portion 116 within a forward venturi channel 136. Forward venturi channel 136 is defined between air swirler flange portion 116 and a downstream side 138 of an annular support plate 140. Support plate 140 is concentrically aligned with respect to combustor center longitudinal axis of symmetry 82, and includes an upstream side 152 coupled to a tubular ferrule 154.

A wishbone joint 160 is integrally formed within exit cone 92 at an aft end 162 of exit cone 92. More specifically, wishbone joint 160 includes a radially inner arm 164, a radially outer arm 166, and an attachment slot 168 defined therebetween.

Deflector-flare cone assembly 75 couples to air swirler 90. More specifically, flare cone portion 78 couples to exit cone 92 and extends downstream from exit cone 92. Flare cone portion 78 includes a radially inner flow surface 182 and a radially outer surface 184. Flare cone inner flow surface 182 is divergent and extends from exit cone 92 to a trailing end 188. Flare cone outer surface 184 is divergent and extends radially outwardly from exit cone 92.

Combustor dome plate 74 secures dome assembly 70 in position within combustor 16 using an outer support plate 220 and an inner support plate 222. Plates 220 and 222 secure combustor dome assembly 70 within combustor 16. More specifically, plates 220 and 222 attach to annular deflector portion 76 which is coupled between plates 220 and 222, and flare cone portion 78.

Deflector portion 76 prevents hot combustion gases produced within combustor 16 from impinging upon the combustor dome plate 74, and includes a flange portion 230, an arcuate portion 232, and a body 234 extending therebetween. Flange portion 230 extends axially upstream from deflector body 234 to a deflector leading edge 236. Deflector arcuate portion 232 extends radially outwardly and downstream from body 234 to a deflector trailing edge 242.

Deflector body 234 has a generally planar inner surface 246 that extends from a forward surface 248 of deflector body 234 to a trailing surface 250 of deflector body 234. Deflector portion 76 also includes a radially outer surface 270 and a radially inner surface 272. Radially outer surface 270 and radially inner surface 272 extend from deflector leading edge 236 across deflector body 234 to deflector trailing edge 242.

An impingement passageway 290 extends axially through deflector body 234. More specifically, passageway 290 extends from an entrance 292 at deflector body inner surface 246 to an exit 294 at deflector trailing surface 250, such that passageway 290 is in flow communication with a flare-air passage 298 defined between deflector portion 76 and flare cone portion 78. Passageway 290 channels cooling fluid therethrough for impingement cooling of flare-cone portion 78. In one embodiment, the cooling fluid is compressed air bled from compressor 14 (shown in FIG. 1). Passageway 290 extends substantially circumferentially within deflector body 234 around combustor center longitudinal axis of symmetry 82.

Figure 3:
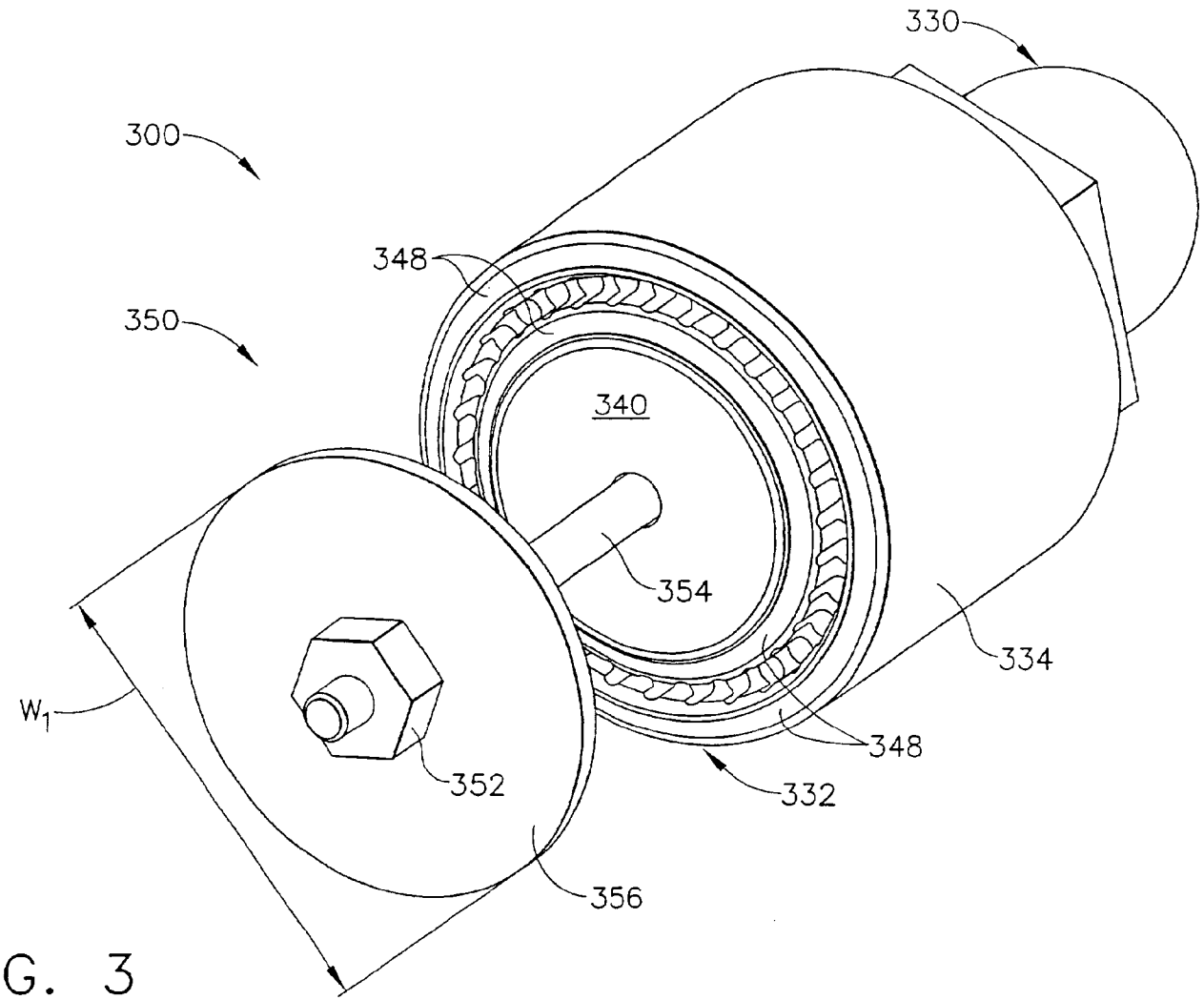
FIG. 3 is a perspective view of a nozzle assembly that may be used to clean the combustor dome assembly shown in FIG. 1.
Figure 4:
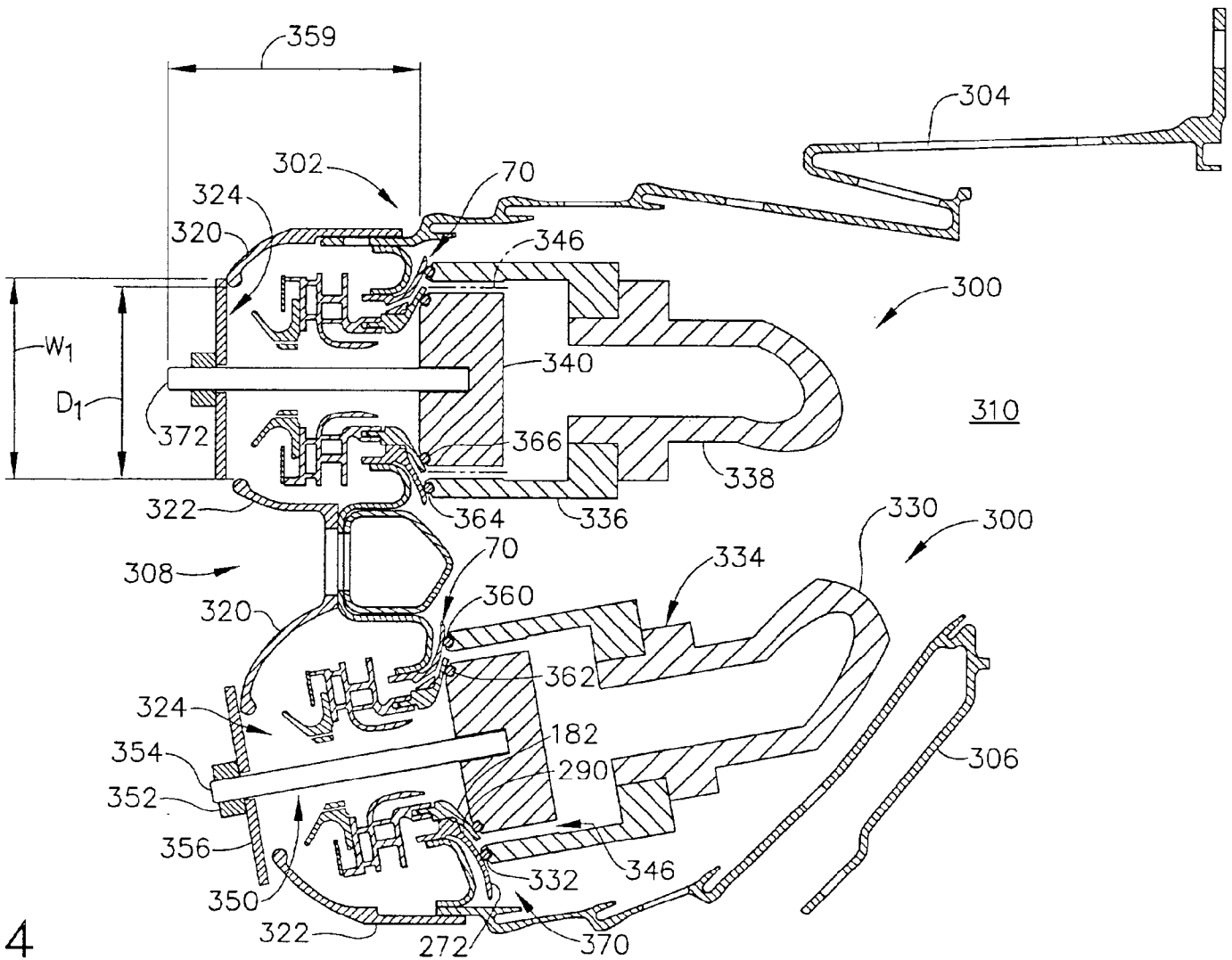
FIG. 4 is a cross-sectional view of the nozzle assembly shown in FIG. 3 coupled within an exemplary combustor that may be used with the engine shown in FIG. 1.

FIG. 3 is a perspective view of a nozzle assembly 300 that may be used to clean dome assembly 70. FIG. 4 is a cross-sectional view of a pair of nozzle assemblies 300 coupled in position within an exemplary combustor 302 that may be used with engine 10. Combustor 302 includes an annular outer liner 304, an annular inner liner 306, and a domed end 308 extending between outer and inner liners 304 and 306, respectively. Outer liner 304 and inner liner 306 define a combustion chamber 310.

Combustion chamber 310 is generally annular in shape and is disposed between liners 304 and 306. Outer and inner liners 304 and 306 extend to a turbine nozzle (not shown) disposed downstream from combustor domed end 308. In the exemplary embodiment, outer and inner liners 304 and 306 each include a cowl 320 and 322, respectively, that define an opening 324 therebetween that has a diameter $D_1$.

In the exemplary embodiment, combustor domed end 308 includes two dome assemblies 70 arranged in a dual annular configuration (DAC). In another embodiment, combustor domed end 308 includes only one dome assembly 70 arranged in a single annular configuration (SAC). In a further embodiment, combustor domed end 308 includes three dome assemblies 70 arranged in a triple annular configuration (TAC).

Nozzle assembly 300 includes an inlet end 330, a discharge end 332, and a hollow body 334 extending therebetween. In the exemplary embodiment, body 334 is formed from a multi-piece assembly that includes a substantially cylindrical portion 336 and a coupling portion 338. Cylindrical portion 336 extends between discharge end 332 and coupling portion 338, and coupling portion 338 extends between portion 336 and inlet end 330. In the exemplary embodiment, inlet end 330 is threaded for coupling nozzle assembly 300 in flow communication with a pressurized fluid source. In one embodiment, water is supplied to nozzle assembly 300 at a pressure of approximately 250 psi. In another embodiment, a cleaning solution is supplied to nozzle assembly 300 at a pressure of approximately 250 psi.

Nozzle assembly 300 also includes a centerbody 340 that is positioned within body 334. In the exemplary embodiment, centerbody 340 has a substantially circular cross-sectional profile. More specifically, centerbody 340 is positioned within cylindrical portion 336 and is aligned substantially concentrically with respect to portion 336 such that a substantially annular gap 346 is defined between centerbody 340 and portion 336. More specifically, gap 346 is segmented such that a plurality of circumferentially-spaced channels 348 are defined within gap 346.

In the exemplary embodiment, a fastener assembly 350 is coupled to, and extends outwardly from centerbody 340. In another embodiment, fastener assembly 350 is formed integrally with centerbody 340. More specifically, fastener assembly 350 includes a fastener 352, a projection rod 354, and an annular flange 356. Rod 354 is concentrically aligned with respect to centerbody 340 and extends a distance 359 outwardly from centerbody 340. In the exemplary embodiment, rod 354 is threaded. In the exemplary embodiment, annular flange 356 has a width $W_1$ that is wider than cowl opening diameter $D_1$.

At discharge end 332, nozzle assembly 300 also includes a radially outer seal member 360 and a radially inner seal member 362. Specifically, outer seal member 360 is positioned within a channel 364 defined within cylindrical portion 336, and inner seal member 362 is positioned within a channel 366 defined within centerbody 340 adjacent an outer periphery of centerbody 340. More specifically, seal members 360 and 362 are adjacent gap 346 such that seal member 360 is radially outward from, and adjacent to, gap 346, and seal member 362 is radially inward from, and adjacent to, gap 346.

During a washing process, initially nozzle assembly 300 is coupled within combustor 302. Specifically, nozzle assembly 300 is coupled to dome assembly 70 to facilitate removing particulate matter from dome assembly 70. More specifically, nozzle assembly 300 is positioned within combustor 302 such that nozzle assembly discharge end 332 is adjacent a downstream side 370 of dome assembly 70, and such that fastener assembly 350 is extended upstream through dome assembly 70. Rod distance 359 enables rod 354 to extend through ferrule 154 and through cowl opening 324 such that an end 372 of rod 354 is upstream from cowls 320 and 322. Annular flange 356 is coupled to rod 354 such that rod 354 extends through annular flange 356, and fastener 352 is then coupled to rod 354 such that annular flange 356 is positioned between fastener 352 and cowls 320 and 322.

As fastener 352 is tightened, annular flange 356 is secured against cowls 320 and 322, and nozzle assembly 300 is secured within combustor 302. Specifically, nozzle assembly 300 is secured such that seal member 360 extends in sealing contact between deflector portion inner surface 272 and nozzle assembly cylindrical portion 336, and such that seal member 362 extends in sealing contact between flare cone inner flow surface 182. Accordingly, when nozzle assembly 300 is secured in position, nozzle assembly gap 346 and channels 348 are coupled in flow communication with flare-air passage 298 and impingement passageway 290.

During washing, pressurized fluid supplied to nozzle assembly 300 is discharged from nozzle assembly into dome assembly 70. More specifically, an annulus of fluid is discharged only into flare-air passage 298, wherein the fluid is channeled upstream and into impingement passageway 290. Because the fluid flow is directed into dome assembly 70 in a direction that is opposite the normal engine airflow, particulate matter that may have accumulated in passageway 290 is more easily flushed from passageway 290 than is possible by injecting fluid into passageway 290 in the same direction as the normal engine airflow.

The above-described nozzle assembly enables a gas turbine combustor dome assembly to be washed/flushed in a cost-effective and reliable manner. The nozzle assembly is coupled to an upstream side and a downstream side of the dome assembly such that the annulus of fluid discharged from the nozzle is discharged upstream into the dome assembly. Accordingly, particulate matter that may have accumulated within the flare-air passage or the impingement passageways is flushed in a cost-effective and reliable manner.

Exemplary embodiments of combustor dome assemblies and nozzle assemblies are described above in detail. The systems and assemblies are not limited to the specific embodiments described herein, but rather, components of each assembly and system may be utilized independently and separately from other components described herein. Each nozzle assembly component can also be used in combination with other combustor and engine components.

While the invention has been described in terms of various specific embodiments, those skilled in the art will recognize that the invention can be practiced with modification within the spirit and scope of the claims.

What is claimed is:

1. A method for washing a gas turbine engine combustor, said method comprising:

coupling a nozzle assembly against the combustor, wherein the nozzle assembly includes an inlet end, a discharge end, a hollow nozzle body extending therebetween, and a centerbody positioned within the nozzle body;

coupling the nozzle assembly to a fluid source; and discharging an annulus of fluid from the nozzle assembly into the combustor to facilitate removing particulate matter from the combustor.

2. A method in accordance with claim 1 wherein discharging an annulus of fluid from the nozzle assembly further comprises discharging fluid from a downstream side of the combustor in an upstream direction from the nozzle assembly into the combustor.

3. A method in accordance with claim 1 wherein coupling a nozzle assembly to the combustor further comprises coupling the nozzle assembly to a downstream side of the combustor.

4. A method in accordance with claim 1 wherein coupling a nozzle assembly to the combustor further comprises coupling the nozzle assembly to the combustor using a threaded fastener extending radially outwardly and concentrically from the nozzle body.

5. A method in accordance with claim 4 wherein coupling a nozzle assembly to the combustor further comprises coupling an annular flange to the threaded fastener; and coupling the nozzle assembly to the combustor such that the annular flange is secured against an upstream side of the combustor while the nozzle body is secured against a downstream side of the combustor.

6. A method in accordance with claim 1 wherein coupling a nozzle assembly to the combustor further comprises threadingly coupling the nozzle assembly inlet end in flow communication to a pressurized fluid source.

7. A nozzle assembly for directing fluid into a gas turbine engine combustor for removing particulate matter from the combustor, said nozzle assembly comprising:

a nozzle body extending between an inlet end and a discharge end, said body defining a cavity therein; and a centerbody positioned within said body such that an annular gap is defined between said centerbody and said nozzle body, said gap is segmented, said centerbody configured to couple said nozzle assembly to the combustor, said nozzle assembly for discharging an annulus of fluid through said gap into the combustor.

8. A nozzle assembly in accordance with claim 7 wherein said centerbody comprises a fastener extending radially outwardly therefrom, said fastener for coupling said nozzle assembly to the combustor such that said nozzle body secured against said combustor.

9. A nozzle assembly in accordance with claim 8 wherein said fastener for coupling said nozzle assembly to a downstream side of the combustor such that fluid is discharged in an upstream direction from said nozzle body through said combustor.

10. A nozzle assembly in accordance with claim 7 wherein said centerbody comprises a threaded rod extending radially outwardly therefrom, said rod aligned substantially concentrically with said nozzle body.

11. A nozzle assembly in accordance with claim 10 further comprising an annular flange coupled to said threaded rod, said annular flange secured against an upstream side of the combustor when said nozzle assembly is secured to a downstream side of the combustor.

12. A nozzle assembly in accordance with claim 7 further comprising a first seal member positioned radially outwardly from said gap, and a second seal member positioned radially inwardly from said gap, said first and second seal members configured to sealingly couple said nozzle assembly to the combustor.

13. A nozzle assembly in accordance with claim 7 wherein said nozzle body inlet end configured to couple in flow communication to a fluid source.

14. A method for washing a gas turbine engine combustor including an air swirler, and a deflector-flare cone assembly that extends circumferentially around the swirler, said method comprising:

coupling a nozzle assembly to the deflector-flare cone assembly, wherein the nozzle assembly includes an inlet end, a discharge end, a hollow nozzle body extending therebetween, and a centerbody positioned within the nozzle body;

coupling the nozzle assembly inlet end to a fluid source; and discharging fluid in an upstream direction from the nozzle assembly into the combustor to facilitate removing particulate matter from the combustor.

15. A method in accordance with claim 14 wherein the combustor deflector-flare cone assembly includes a deflector portion and a flare cone portion, said discharging fluid in an upstream direction from the nozzle assembly further comprises discharging an annulus of fluid between the deflector portion and the flare cone portion such that the fluid is forcibly channeled through an impingement cooling slot formed in the deflector portion.

16. A method in accordance with claim 14 wherein the combustor includes a ferrule that is upstream from the deflector wherein coupling a nozzle assembly to the deflector-flare cone assembly further comprises coupling the nozzle assembly to the ferrule such that the nozzle assembly discharge end is secured against the combustor deflector-flare cone assembly.

17. A method in accordance with claim 16 wherein coupling the nozzle assembly to the ferrule further comprises coupling the nozzle assembly to the ferrule using a fastener extending radially outwardly from the nozzle assembly centerbody.

18. A method in accordance with claim 16 wherein coupling the nozzle assembly to the ferrule further comprises positioning the nozzle assembly against a downstream side of the combustor;

coupling an annular flange to a fastener rod extending from the centerbody of the nozzle assembly; and coupling a fastener to the rod such that the annular flange is secured against an upstream side of the combustor and between the combustor and the fastener.

19. A method in accordance with claim 14 wherein the combustor deflector-flare cone assembly includes a deflector portion and a flare cone portion, said coupling a nozzle assembly to the deflector-flare cone assembly further comprises:

positioning a first seal member between the deflector portion and the nozzle assembly; and positioning a second seal member between the flare cone portion and the nozzle assembly.

20. A method in accordance with claim 14 wherein coupling a nozzle assembly to the deflector-flare cone assembly further comprises coupling the nozzle assembly to the deflector-flare cone assembly such that a seal is formed between the nozzle assembly and the deflector-flare cone assembly.

* * * * *